US007570233B2

(12) United States Patent
Iwabuchi et al.

(10) Patent No.: US 7,570,233 B2
(45) Date of Patent: Aug. 4, 2009

(54) DISPLAY DEVICE

(75) Inventors: Tomoyuki Iwabuchi, Atsugi (JP); Aya Anzai, Tsukui (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 643 days.

(21) Appl. No.: 11/281,860

(22) Filed: Nov. 18, 2005

(65) Prior Publication Data

US 2006/0109216 A1 May 25, 2006

(30) Foreign Application Priority Data

Nov. 24, 2004 (JP) ..... 2004-339671

(51) Int. Cl.
*G09G 3/30* (2006.01)

(52) U.S. Cl. ..... 345/76; 345/204; 345/92

(58) Field of Classification Search ..... 345/76
See application file for complete search history.

(56) References Cited

U.S. PATENT DOCUMENTS

| | | | | |
|---|---|---|---|---|
| 6,528,951 | B2 | 3/2003 | Yamazaki et al. | |
| 6,828,950 | B2 | 12/2004 | Koyama | |
| 2001/0030511 | A1 | 10/2001 | Yamazaki et al. | |
| 2001/0033252 | A1 | 10/2001 | Yamazaki et al. | |
| 2003/0132716 | A1* | 7/2003 | Yamazaki et al. | 315/169.3 |
| 2003/0209989 | A1 | 11/2003 | Anzai et al. | |
| 2005/0001795 | A1* | 1/2005 | Kitahara | 345/76 |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |

FOREIGN PATENT DOCUMENTS

| | | |
|---|---|---|
| JP | 11-272235 | 10/1999 |
| JP | 2002-333861 | 11/2002 |
| JP | 2003-323159 | 11/2003 |

OTHER PUBLICATIONS

Tomoyuki Iwabuch et al.; "Development of a 1.51-in Quarter-XGA (Monochrome 423ppi) Fully Integrated AMOLED Display and a Proposal of its Applications"; *SID '05 Digest*; pp. 265-267; 2005.

* cited by examiner

*Primary Examiner*—Kent Chang
*Assistant Examiner*—Jonathan Boyd
(74) *Attorney, Agent, or Firm*—Fish & Richardson P.C.

(57) ABSTRACT

A display device which operates appropriately independently of the manufacture variations of each element formed over a substrate is provided without increasing the number of components. The display device includes an external correction circuit and a panel, and the external correction circuit and the panel are connected to each other through a flexible printed wiring connecting portion. The panel includes a signal line driver circuit, a scan line driver circuit, a pixel portion, a monitoring element portion, a D/A converter and a constant current source. When mounting the D/A converter on a substrate, the number of external circuit components can be reduced without increasing flexible printed wiring terminals by supplying a digital signal inputted to the D/A converter from a video signal line, and controlling the sampling timing of the digital signal with a signal used in the panel.

4 Claims, 11 Drawing Sheets

DISPLAY DEVICE

BACKGROUND OF THE INVENTION

1. Field of the Invention

The present invention relates to a driver circuit of a display device and a display device using the driver circuit. In particular, the invention relates to a technique for correcting luminance of a light-emitting element.

2. Description of the Related Art

As a monitor of a television receiver or a personal computer, demand for a thin display has been rapidly increasing, and further development thereof has been advanced. As a typical example of the thin display, a liquid crystal display is known. In recent years, a display utilizing an electroluminescence element (hereinafter also referred to as an 'EL element') is also developed. Such a display utilizing an EL element has the advantages of a thin shape, light weight and high image quality as well as high response speed and wide viewing angle. Therefore, it is expected as a next-generation display.

However, the EL element using an organic material has a problem in that the resistance thereof changes with time, which leads to a decrease in the light-emission efficiency. Further, it has another problem in that the resistance thereof changes in accordance with changes in the ambient temperature of the EL element. In order to solve such problems, a display provided with a monitoring element has been developed (e.g., see Patent Document 1). The display is provided with a monitoring element having a common cathode to an EL element in a pixel portion, and a constant current is supplied to the monitoring element so that a voltage value of an anode of the monitoring element is sampled. By using the sampled voltage value as an anode voltage of the EL element in the pixel portion, a current value of the EL element can be constant even when the resistance value thereof has changed, thereby a difference between the actual current and the desired current can be minimized. As a driving method, a digital time gray scale method is adopted.

A display shown in FIG. 2 is provided with an external circuit 2004 and a panel 2010. The external circuit 2004 includes a constant current source circuit 2001, a power source 2002 and a signal generator 2003, which is connected to the panel 2010 through a flexible printed wiring (FPC) connecting portion 2005. The panel 2010 includes a signal line driver circuit 2006, a scan line driver circuit 2007, a pixel portion 2009 provided with an EL element 2011 and a monitoring element portion 2012 over a substrate 2008.

The power source 2002 generates power having desired voltage values based on the power supplied from a battery or an AC power source, and supplies the power to various circuits incorporated in the display. The signal generator 2003 receives power, video signals, synchronous signals and the like, and generates clock signals for driving the signal line driver circuit 2006 and the scan line driver circuit 2007 as well as converting various signals. The EL element 2011 in each pixel is controlled to emit light or no light with a digital video signal from the signal line driver circuit 2006 and a selection pulse from the scan line driver circuit 2007. The constant current source circuit 2001 supplies a desired current value to the monitoring element portion 2012, and a potential sampled at an anode portion of the monitoring element portion 2012 is used as an anode potential of the EL element in the pixel portion 2009.

[Patent Document 1]

Japanese Patent Laid-Open No. 2002-333861

However, when the constant current source circuit 2001 for supplying a constant current to the monitoring element portion 2012 is formed with thin film transistors (hereinafter also referred to as 'TFTs') over the substrate 2008, the current value supplied from the constant current source circuit 2001 fluctuates due to characteristic variations of TFTs in each production lot or each panel. Furthermore, the current value supplied from the constant current source circuit 2001 is required to be set by taking into consideration the variations in the film deposition of EL elements. In order to control the output value of the constant current source circuit 2001, a larger number of components is required, which is disadvantageous.

SUMMARY OF THE INVENTION

The invention is made in view of the foregoing problems, and it is a primary object of the invention to provide a display device which is capable of operating appropriately independently of the manufacture variations of each element formed over a substrate. It is another object of the invention to provide such a display device without increasing the number of components.

A display device of the invention is provided with a function to control an output current value of a current source circuit, a correction function of changes in the ambient temperature and a correction function of a degradation with time of an EL element (hereinafter also collectively referred to as a compensation function).

According to one aspect of the invention, a display device is provided which includes a D/A converter for converting a digital signal into an analog signal; a constant current source which is electrically connected to the D/A converter; and a monitoring element portion which is electrically connected to the constant current source and receives a current supply from the constant current source. An output current value of the constant current source is controlled based on an output potential of the analog signal.

According to one aspect of the invention, a display device is provided which includes a D/A converter for converting a digital signal into an analog signal; a constant current source which is electrically connected to the D/A converter; and a monitoring element portion which is electrically connected to the constant current source and receives a current supply from the constant current source. The constant current source includes a thin film transistor which operates in the saturation region with an output potential of the analog signal as a gate potential.

According to one aspect of the invention, a display device is provided which includes a first wiring for transmitting a digital video signal to be inputted to a signal line driver circuit; a second wiring branched from the first wiring; the signal line driver circuit or a scan line driver circuit which is electrically connected to the first wiring; a D/A converter which is electrically connected to the second wiring and coverts a digital signal into an analog signal; a constant current source which is electrically connected to the D/A converter; and a monitoring element portion which is electrically connected to the constant current source and receives a current supply from the constant current source. An output current value of the constant current source is controlled based on an output potential of the analog signal.

According to one aspect of the invention, a display device is provided which includes a first wiring for transmitting a digital video signal to be inputted to a signal line driver circuit; a second wiring branched from the first wiring; the signal line driver circuit or a scan line driver circuit which is electrically connected to the first wiring; a D/A converter which is electrically connected to the second wiring and coverts a digital signal into an analog signal; a constant current source which is electrically connected to the D/A converter; and a monitoring element portion which is electrically connected to the constant current source and receives a current supply from the constant current source. The constant current source includes a thin film transistor which operates in the saturation region with an output potential of the analog signal as a gate potential.

A display device with the aforementioned configuration further includes a pixel portion having a light-emitting element. A potential difference of the monitoring element portion is detected and a potential to be inputted to the light-emitting element is set based on the detected potential difference.

According to one aspect of the invention, a display device is provided which includes a first D/A converter circuit for converting a first digital signal corresponding to a first light-emission color into a first analog signal; a second D/A converter for converting a second digital signal corresponding to a second light-emission color into a second analog signal; a third D/A converter for converting a third digital signal corresponding to a third light-emission color into a third analog signal; a first constant current source which is electrically connected to the first D/A converter; a second constant current source which is electrically connected to the second D/A converter; a third constant current source which is electrically connected to the third D/A converter; a first monitoring element portion which is electrically connected to the first constant current source and receives a current supply for the first light-emission color from the first constant current source; a second monitoring element portion which is electrically connected to the second constant current source and receives a current supply for the second light-emission color from the second constant current source; and a third monitoring element portion which is electrically connected to the third constant current source and receives a current supply for the third light-emission color from the third constant current source. An output current value of the first constant current source is controlled based on an output potential of the first analog signal; an output current value of the second constant current source is controlled based on an output potential of the second analog signal; and an output current value of the third constant current source is controlled based on an output potential of the third analog signal.

A display device with the aforementioned configuration further includes a pixel portion having a first light-emitting element, a second light-emitting element, and a third light-emitting element. A potential difference of the first monitoring element portion is detected, thereby setting a potential to be inputted to the first light-emitting element based on the detected potential difference; a potential difference of the second monitoring element portion is detected, thereby setting a potential to be inputted to the second light-emitting element based on the detected potential difference; and a potential difference of the third monitoring element portion is detected, thereby setting a potential to be inputted to the third light-emitting element based on the detected potential difference.

In the aforementioned configuration of the invention, the digital signal is sampled during a fly-back period, and the digital signal is a video signal.

In the display device of the invention, a digital video signal inputted to the signal line driver circuit is branched, and the digital signal is read out at specific timing. Then, the digital signal is converted into an analog signal by the D/A converter so that the analog voltage is inputted to the constant current source. Since the constant current source can be controlled with the analog voltage, the number of components or input terminals is not required to be increased. In addition, a monitoring element is formed over the same substrate as the constant current source; therefore, when the ambient temperature changes on the condition that the monitoring element is driven with a constant current, the resistance value thereof changes. When the resistance value of the monitoring element changes, a potential difference between opposite electrodes of the monitoring element changes since the current value supplied to the monitoring element at this time is constant. By detecting the potential difference of the monitoring element, changes in the ambient temperature can be detected. A potential of an electrode of the monitoring element which is not electrically connected to the constant current source is constant. Accordingly, changes in the potential of the electrode of the monitoring element which is electrically connected to the constant current source can be detected. Further, since a current inputted to each monitoring element for R, G or B can be controlled independently of each other, a potential change of each electrode of the monitoring element can be detected for each of R, G and B. The constant current source drives the monitoring element with a constant current; therefore, by sampling a voltage of the monitoring element in accordance with the degradation with time of the monitoring element and setting an anode potential of an EL element in a pixel portion based on the sampled voltage, a luminance decay of the EL element in the pixel portion can be suppressed. That is, since the D/A converter and the monitoring element are connected to each other through the constant current source, a current inputted to the monitoring element can be controlled with an analog signal voltage.

According to the invention, a constant current source can be formed over the same substrate as a pixel portion, a monitoring element portion and the like. In addition, the current value of the constant current source can be controlled without increasing the number of components. Accordingly, fluctuation in current values of an EL element in the pixel portion due to the luminance decay thereof with time can be suppressed by sampling data on the voltage of the monitoring element and setting an anode potential of the EL element in the pixel portion based on the sampled voltage.

DETAILED DESCRIPTION OF THE INVENTION

Although the invention will be fully described by way of embodiment modes with reference to the accompanying drawings, it is to be understood that various changes and modifications will be apparent to those skilled in the art.

Therefore, unless otherwise such changes and modifications depart from the scope of the invention, they should be construed as being included therein.

Although a display device having an EL element is exemplarily described below, the invention is not limited to this, and the invention can be similarly applied to other display devices so long as a monitoring element and a D/A converter are provided.

Figure 1A:
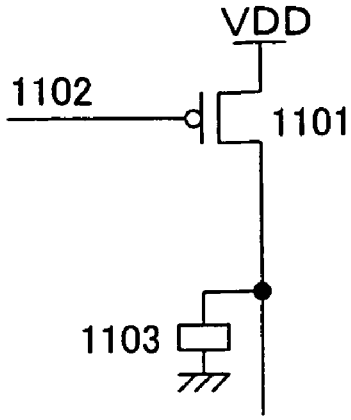
FIGS. 1A and 1B illustrate a configuration example of the invention.

FIG. 1A shows a configuration example in which an output current value of a constant current source circuit 1201 is completed a panel is completed. A constant current source TFT 1101 and a terminal 1102 connected to a gate electrode of the constant current source TFT 1101 are provided, and the constant current source TFT 1101 is driven in the saturation region. By changing a potential applied to the terminal 1102, a current value supplied to a monitoring element 1103 can be controlled.

Figure 1B:
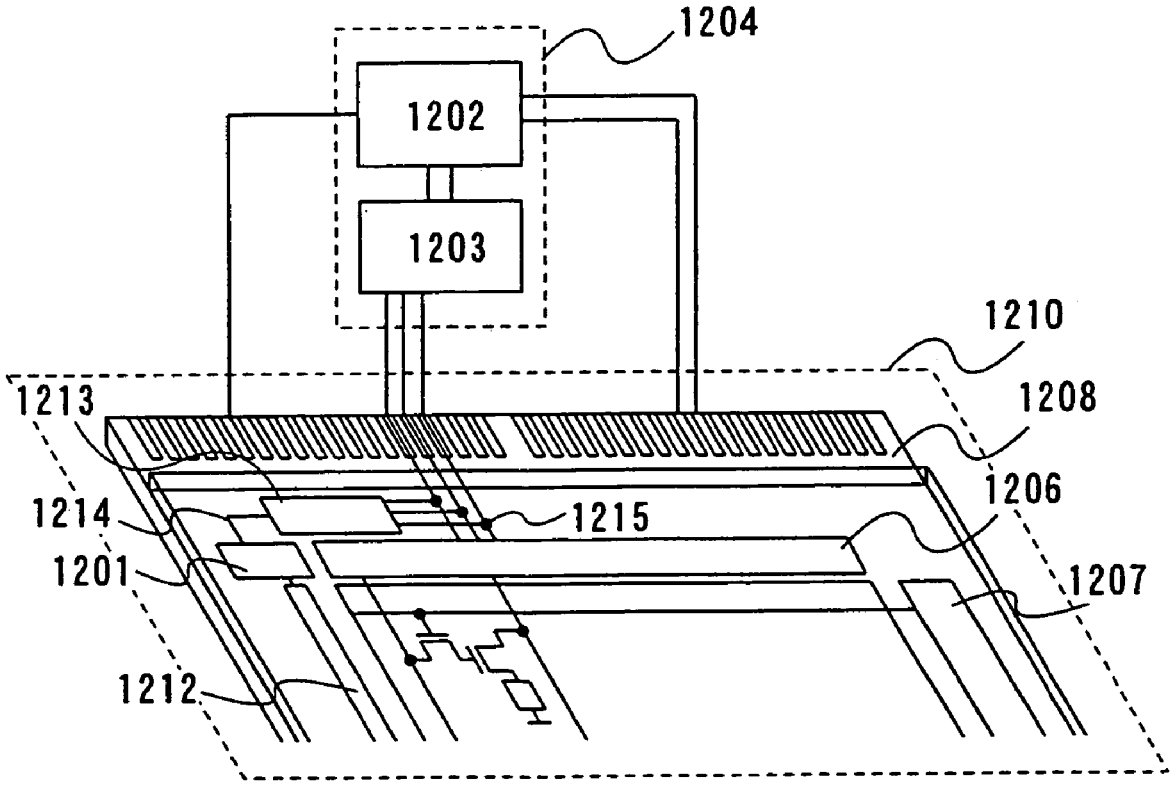
Figure 2:
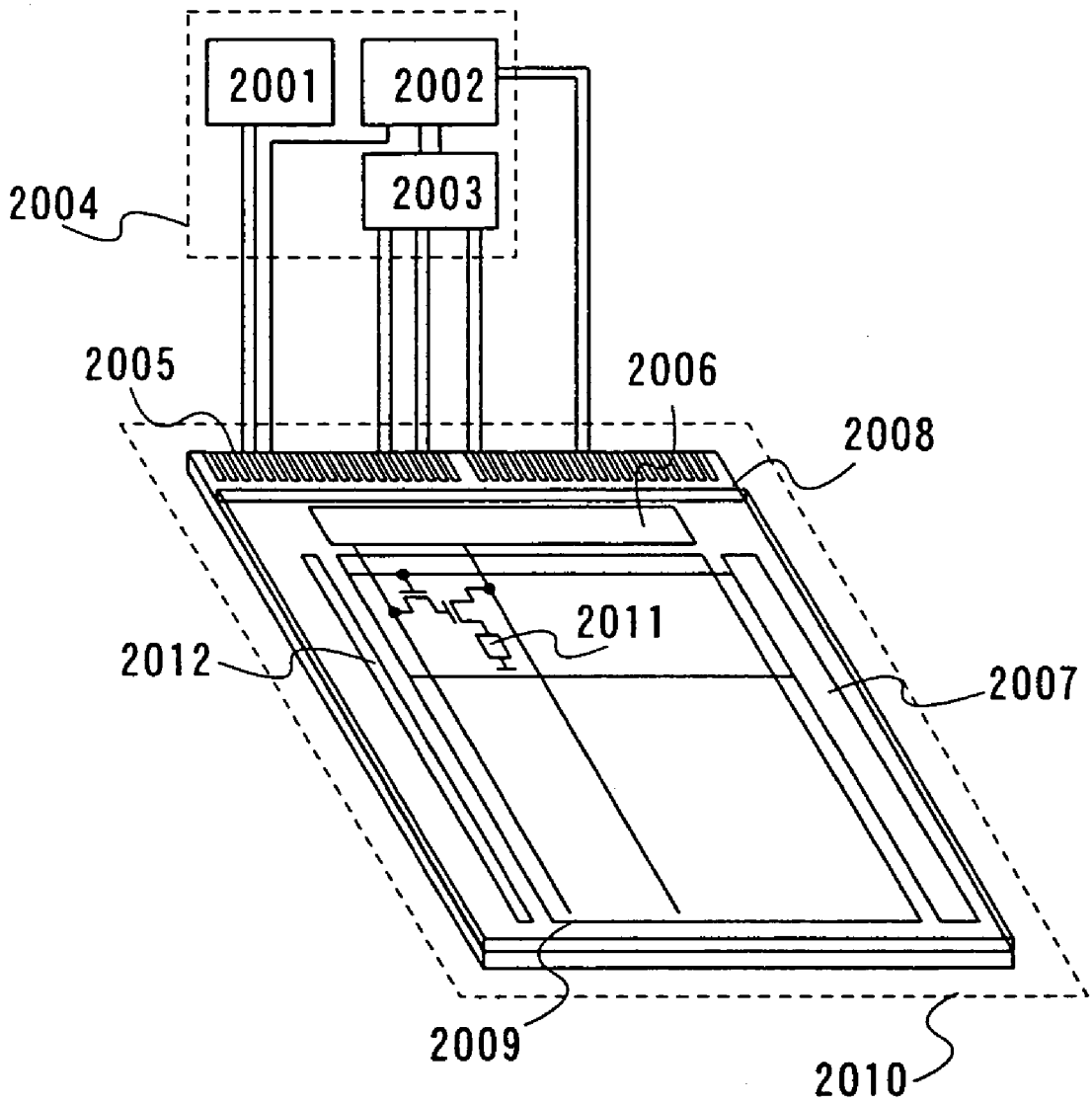
FIG. 2 illustrates a configuration example of the prior art.

In this case, if a potential applied to the terminal 1102 is supplied from an external circuit, a variable power source is required to be provided in the external circuit. Accordingly, the number of FPC terminals is increased. Then, as shown in FIG. 1B, a D/A converter 1213 is manufactured over a substrate 1208 having a monitoring element portion 1212, and an output potential of the D/A converter 1213 is applied to a terminal 1214 inputted to the constant current source circuit 1201. Therefore, a power source 1202 in an external circuit 1204 is not required to have a variable power source, and thus the number of components can be reduced. In this case, if a digital signal inputted to the D/A converter 1213 from a signal generator 1203 through a video signal line 1215 is supplied from a video signal line inputted to a signal line driver circuit 1206, and the timing for sampling the digital signal is controlled with a signal used in a panel 1210, FPC terminals are not required to be increased. Alternatively, the digital signal inputted to the D/A converter 1213 may be supplied from a video signal line inputted to a scan line driver circuit 1207.

In this manner, when mounting the D/A converter on the substrate, the number of external circuit components can be reduced without increasing FPC terminals by supplying a digital signal inputted to the D/A converter from a video signal line and controlling the sampling timing of the digital signal with a signal used in the panel.

EMBODIMENT MODE 1

Figure 3:
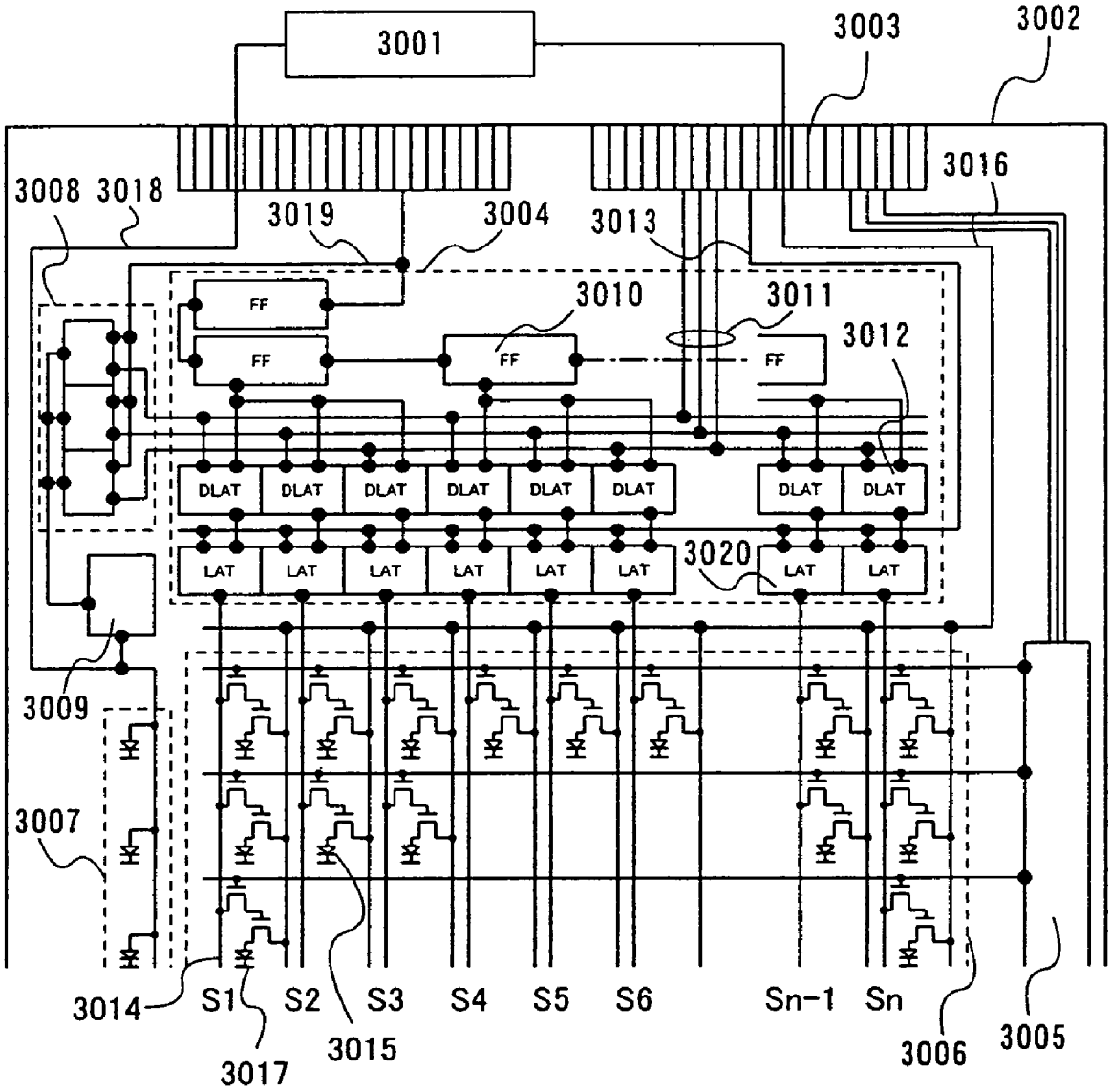
FIG. 3 illustrates Embodiment Mode 1.

FIG. 3 shows a configuration example of a display device in this embodiment mode. The display device includes an external correction circuit 3001 and a panel 3002, which are connected to each other through an FPC connecting portion 3003. The panel 3002 includes a signal line driver circuit 3004, a scan line driver circuit 3005, a pixel portion 3006, a monitoring element portion 3007, a D/A converter 3008 and a constant current source circuit 3009.

The signal line driver circuit 3004 includes a shift register having a plurality of stages of flip flops 3010, a data latch circuit 3012 for latching (holding) video signals outputted from a video signal line 3011 at the timing of a selection pulse outputted from the flip flop 3010, and a latch circuit 3020 for outputting the video signals to signal lines 3014 of all the stages all at once at the timing of a latch signal outputted from a latch signal line 3013.

The video signal outputted to the signal line 3014 is written to a pixel of a selected row by the scan line driver circuit 3005. In accordance with a potential of the video signal, each EL element 3015 is controlled to emit light or no light.

The absolute value of the luminance of the EL element 3015 is proportionate to a current value which flows from an anode line 3016 to a cathode 3017. However, when the resistance value of the EL element 3015 changes due to changes in the ambient temperature or degradation with time while the potential difference between the anode line 3016 and the cathode 3017 is constant, the current value supplied to the EL element 3015 changes, thereby the desired luminance cannot be obtained.

Therefore, a constant current outputted from the constant current source circuit 3009 is supplied to the monitoring element portion 3007, and the potential change of a monitoring line 3018 is sampled. The potential of the monitoring line 3018 is inputted to the external correction circuit 3001, and then outputted to the anode line 3016. The external correction circuit 3001 is a circuit for supplying a potential of the monitoring line 3018 to the anode line 3016 independently of the input impedance of the anode line 3016 and the like. By such a mechanism, a difference between the actual luminance and the desired luminance can be minimized even when the resistance value of the EL element 3015 has changed.

Note that the display device shown in this embodiment mode employs a digital time gray scale method, and a video signal is divided into three signals to reduce the frequency of the signal line driver circuit 3004. However, the division number is not limited to this. The signal line driver circuit 3004 may have a level shifter in accordance with a power source voltage, a signal voltage and the like, and may incorporate a buffer and the like in consideration of the load capacitance of the signal line 3014 and the like. Note that the directions of the EL element 3015 and the monitoring element portion 3007 and the directions of the anode and cathode are not limited to these.

EMBODIMENT MODE 2

Figure 4A:
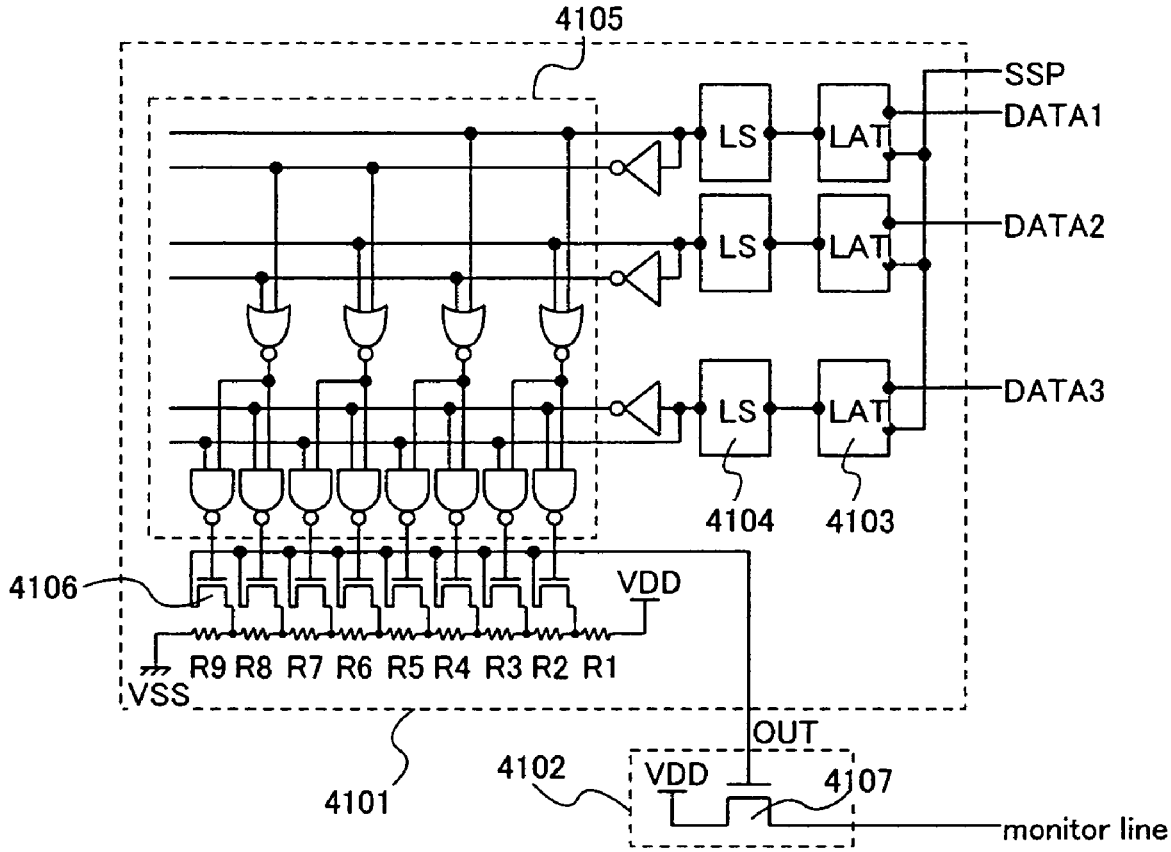
FIGS. 4A and 4B illustrate Embodiment Mode 2.

FIG. 4 shows a specific configuration example of the D/A converter 3008 and the constant current source circuit 3009 described in Embodiment Mode 1. Although a D/A converter having an input of 3 bits is shown here, the invention is not limited to this.

Video signals DATA1, DATA2 and DATA3 and a start pulse SSP are inputted to input terminals of a D/A converter 4101, and an output terminal OUT is inputted to a constant current source circuit 4102. The D/A converter 4101 includes a latch circuit 4103 for latching (holding) the inputted video signals of the DATA1 to DATA3, a level shifter 4104 for amplifying an output of the latch circuit, a selection circuit 4105 having NOR circuits and NAND circuits for selecting one of TFTs 4106, the TFTs 4106 which are turned on/off by the output from the selection circuit 4105, and resistors R1 to R9 for resistance-dividing the voltage of the positive power source VDD and the negative power source VSS.

In accordance with the data of the video signals DATA1 to DATA3, which of the TFTs 4106 is to be turned on is determined. By the TFT which is turned on, the potential of the OUT is varied. In addition, by controlling the resistance ratio of the R1:R9:R2 to R8, the variable range of the OUT potential is determined.

Figure 4B:
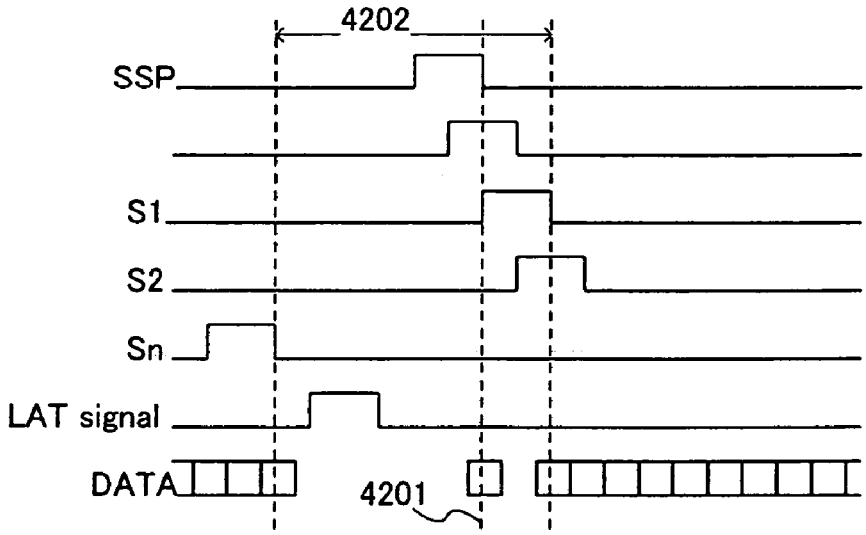

FIG. 4B shows the timing for sampling data from the video signals DATA1 to DATA 3 by the D/A converter 4101. Each node is the same as that in FIG. 3. In this embodiment mode, a start pulse SSP 3019 inputted to the signal line driver circuit 3004 is used as the sampling timing. Accordingly, data may be outputted from the video signals DATA1 to DATA3 at an input timing 4201 (specifically, at the rising edge of the start pulse SSP).

The sampling timing used as the timing for sampling video signals is not limited to the timing of the start pulse SSP, but a latch signal or the like may be used. Any signal may be used so long as it is sampled during a fly-back period 4202 and obtained in the panel 3002. For example, a dummy stage of the flip flop 3010 in the shift register may be increased so that the output of the dummy stage is utilized. Further, the start pulse SSP and the latch signal may be used in common. Note that the dummy stage here means a flip flop which is provided in addition to the flip flops used to perform a normal function (circuit of the display device). The dummy stage is provided, for example, for inspection. Needless to say, a dummy stage for determining the sampling timing may be provided in the invention.

The constant current source circuit 4102 has a constant current source TFT 4107, and supplies a constant current to a monitoring line when it is driven in the saturation region. Note that a current constantly flows between the positive power source VDD and the negative power source VSS; therefore, the total resistance value of the resistors R1 to R9 is preferably set large. Desirably, it is set to 2.5 MO or higher.

Although the description has been made on the case where the anode is connected to one power source in this embodiment mode, in the case of performing color display, a monitoring element portion, a constant current source circuit and a D/A converter may be provided correspondingly to the light-emission color of each pixel. For example, a monitoring element portion, a constant current source circuit and a D/A converter may be provided for each of red (R), green (G) and blue (B). At this time, the monitoring element portion may have either a single or a plurality of EL elements. In the following Embodiment Mode 3, an example is shown where a monitoring element portion, a constant current source circuit and a D/A converter are provided for each of red (R), green (G) and blue (B).

EMBODIMENT MODE 3

Figure 11:
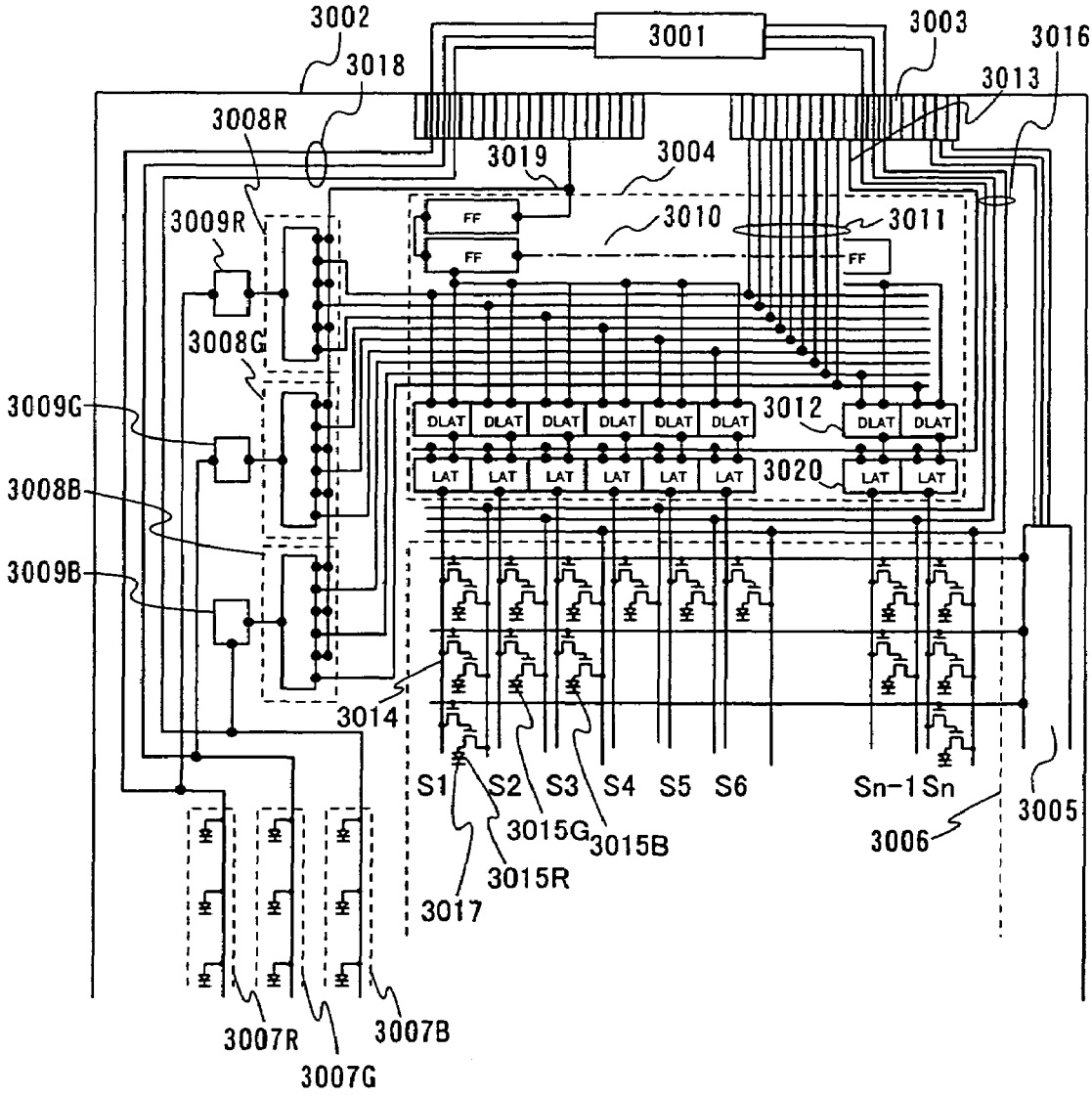
FIG. 11 illustrates Embodiment Mode 3.

As shown in FIG. 3, the pixel portion 3006 is provided with the EL element 3015. When a plurality of light-emission colors of EL elements are provided, monitoring elements are provided in a similar manner. Typically, when color display is performed by an RGB method, three light-emission colors of EL elements are provided to constitute one pixel. Similarly, three light-emission colors of monitoring elements are provided correspondingly. FIG. 11 illustrates such a case. Needless to say, in the case of using a white EL element, a similar monitoring element may be provided.

This display device includes the external correction circuit 3001 and the panel 3002. The external correction circuit 3001 and the panel 3002 are connected to each other through the FPC connecting portion 3003. The panel 3002 includes the signal line driver circuit 3004, the scan line driver circuit 3005, the pixel portion 3006, a monitoring element portion for R: 3007R, a monitoring element portion for G: 3007G, a monitoring element portion for B: 3007B, a D/A converter for R: 3008R, a D/A converter for G: 3008G, a D/A converter for B: 3008B, a constant current source circuit for R: 3009R, a constant current source circuit for G: 3009G, and a constant current source circuit for B: 3009B.

The signal line driver circuit 3004 includes a shift register having a plurality of stages of the flip flops 3010, the data latch circuit 3012 for latching (holding) video signals outputted from the video signal line 3011 at the timing of a selection pulse outputted from the flip flop 3010, and the latch circuit 3020 for outputting the video signals to signal lines 3014 of all the stages all at once at the timing of a latch signal outputted from the latch signal line 3013.

The video signal outputted to the signal line 3014 is written to a pixel of a selected row by the scan line driver circuit 3005. In accordance with a potential of the video signal, each of the EL element (R) 3015R, the EL element (G) 3015G, and the EL element (B) 3015B is controlled to emit light or no light.

The absolute value of each luminance of the EL element (R) 3015R, the EL element (G) 3015G, and the EL element (B) 3015B is proportionate to a current value which flows from the anode line 3016 to the cathode 3017. However, when the resistance value of each of the EL element (R) 3015R, the EL element (G) 3015G and the EL element (B) 3015B changes due to changes in the ambient temperature or degradation with time while the potential difference between the anode line 3016 and the cathode 3017 is constant, the current value supplied to each of the EL element (R) 3015R, the EL element (G) 3015G, and the EL element (B) 3015B changes, thereby the desired luminance cannot be obtained.

Therefore, a constant current outputted from the constant current source circuit for R (3009R) is supplied to the monitoring element portion for R (3007R); a constant current outputted from the constant current source circuit for G (3009G) is supplied to the monitoring element portion for G (3007G); and a constant current outputted from the constant current source circuit for B (3009B) is supplied to the monitoring element portion for B (3007B); and then the potential change of the monitoring line 3018 is sampled. The potential of the monitoring line 3018 is inputted to the external correction circuit 3001, and then outputted to the anode line 3016. The external correction circuit 3001 is a circuit for supplying a potential of the monitoring line 3018 to the anode line 3016 independently of the input impedance of the anode line 3016 and the like. By such a mechanism, a difference between the actual luminance and the desired luminance can be minimized even when the resistance value of each of the EL element (R) 3015R, the EL element (G) 3015G, and the EL element (B) 3015B has changed.

Note that the display device shown in this embodiment mode employs a digital time gray scale method, and a video signal is divided into nine signals to reduce the frequency of the signal line driver circuit 3004. However, the division number or the like is not limited to this. The signal line driver circuit 3004 may have a level shifter in accordance with a power source voltage, a signal voltage and the like, and may incorporate a buffer and the like in consideration of the load capacitance of the signal line 3014 and the like. Note that the directions of each of the EL element (R) 3015R, the EL element (G) 3015G and the EL element (B) 3015B, and the directions of the anodes and cathodes are not limited to these. In addition, a display device having pixels each including an R, G, B or W (White) light-emitting element may be applied to the invention. In the case of using the invention, at least a monitoring element portion, a constant current source circuit, and a D/A converter are required for each color of pixels.

EMBODIMENT MODE 4

Description is made on one configuration example of the display device described in Embodiment Modes 1 and 2 with reference to the drawings.

Figure 5:
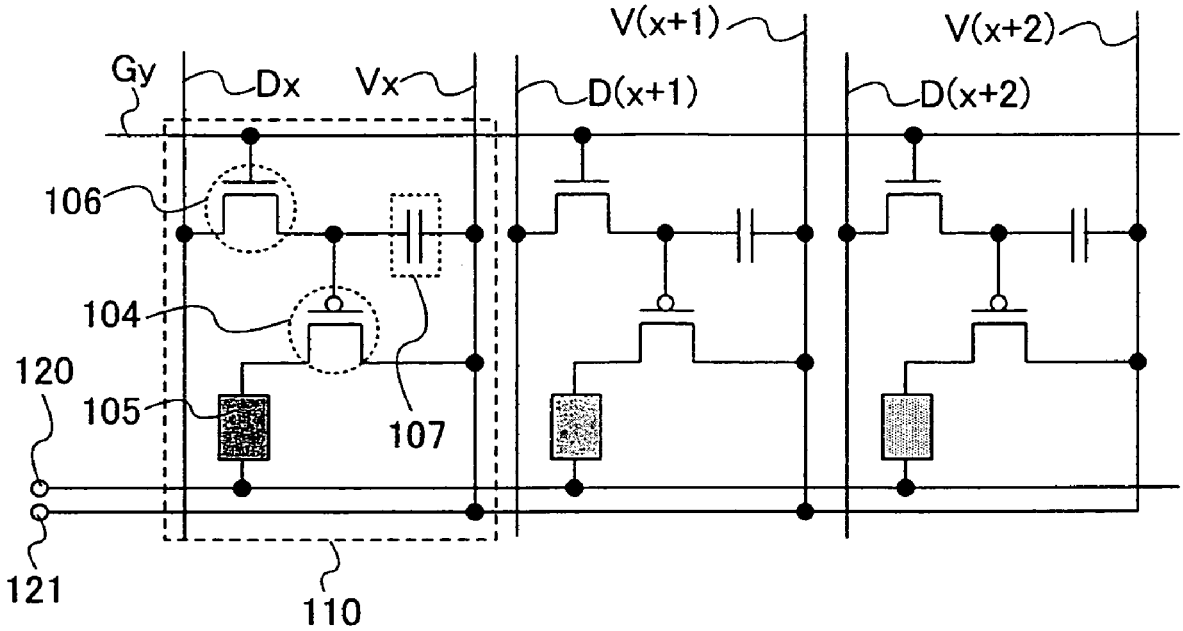
FIG. 5 illustrates an example of a circuit of a pixel in the display device of the invention.

A pixel 110 shown in FIG. 5 has an example in which two transistors are provided. The pixel 110 is provided in a region where a data line Dx (x is a natural number, 1=x=m) intersects with a scan line Gy (y is a natural number, 1=y=n) with an insulating layer interposed therebetween. The pixel 110 includes an EL element 105, a capacitor 107, a switching transistor 106 and a driving transistor 104. The switching transistor 106 controls an input of video signals, and the driving transistor 104 controls the light emission and non-light emission of the EL element 105. These transistors are field effect transistors, and for example, thin film transistors can be used.

A gate of the switching transistor 106 is connected to the scan line Gy and one of a source and drain thereof is connected to the data line Dx while the other is connected to a gate of the driving transistor 104. One of a source and drain of the driving transistor 104 is connected to a first power source line 121 though a power source line Vx (x is a natural number, 1=x=m) while the other is connected to the EL element 105. An end of the EL element 105 which is not connected to the first power source line 121 is connected to a second power source line 120.

The capacitor 107 is provided between the gate and source of the driving transistor 104. The switching transistor 106 and the driving transistor 104 may be either n-channel transistors or p-channel transistors. In the pixel 110 shown in FIG. 5, the switching transistor 106 is an n-channel transistor while the driving transistor 104 is a p-channel transistor. The potentials of the first power source line 121 and the second power source line 120 are not specifically limited. The potentials of the first power source line 121 and the second power source line 120 are set to be different from each other so that a forward voltage or a reverse voltage is applied to the EL element 105.

Figure 6:
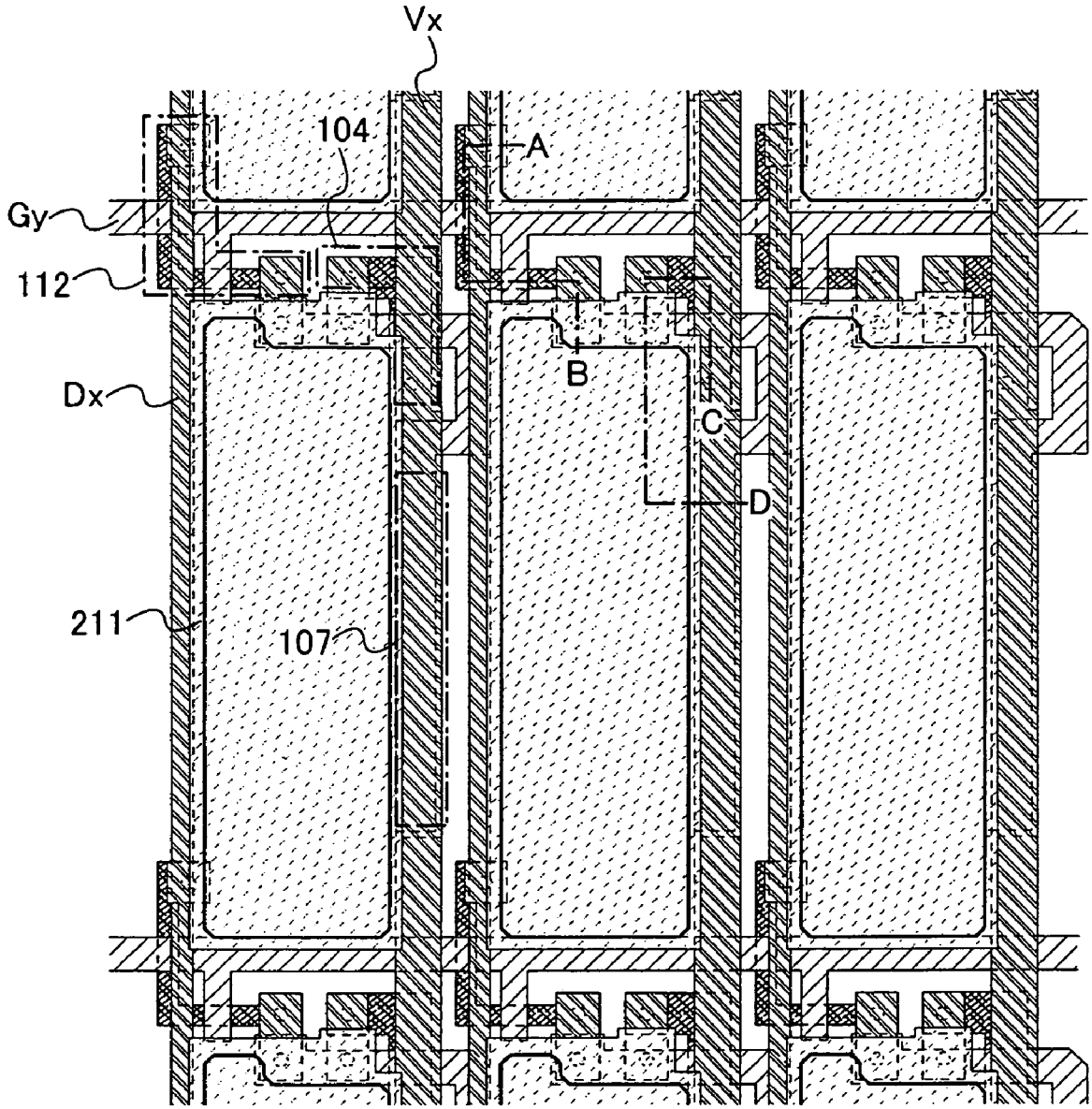
FIG. 6 illustrates an example of a pixel in the display device of the invention.

FIG. 6 shows a plan view of the pixel 110. A switching transistor 112, the driving transistor 104 and the capacitor 107 are disposed. A first electrode 211 is one of the two electrodes of the EL element 105. By stacking a light-emitting layer over the first electrode 211, the EL element 105 connected to the driving transistor 104 is formed. The capacitor 107 is provided to overlap the power source line Vx in order to increase the aperture ratio.

Figure 7A:
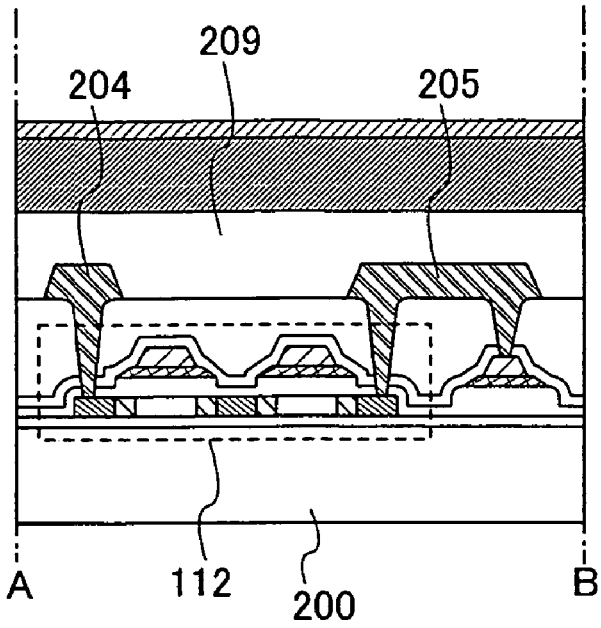
FIGS. 7A and 7B are longitudinal cross-sectional views illustrating an configuration example of a display portion in the display device of the invention.
Figure 7B:
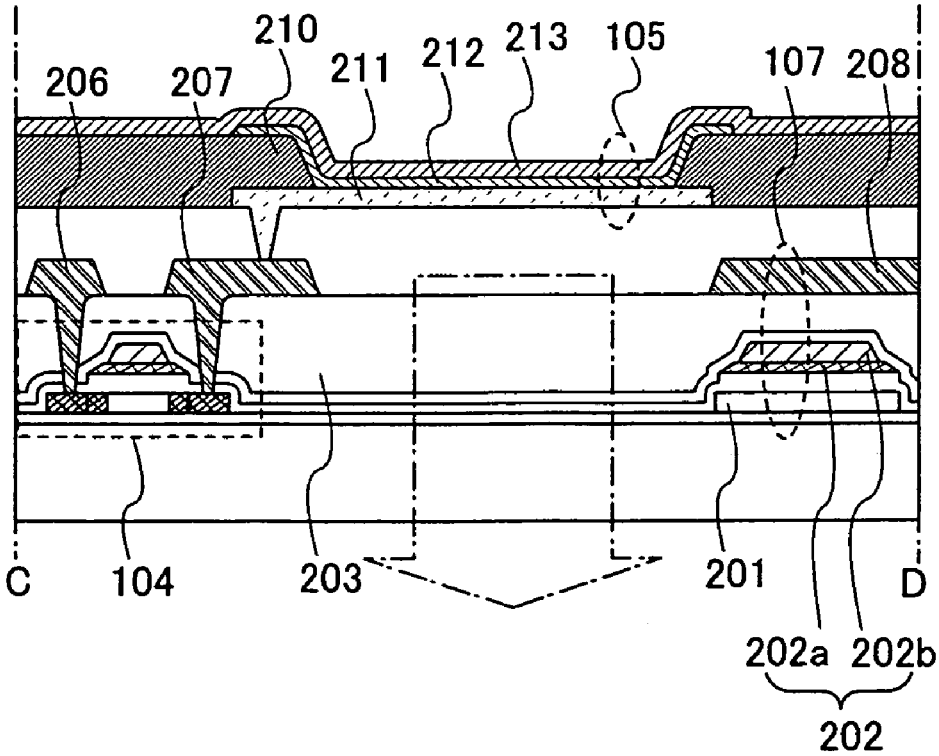

FIGS. 7A and 7B show cross-sectional structures along section lines A-B and C-D shown in FIG. 6 respectively. Over a substrate 200 having an insulating surface such as glass or quartz, the switching transistor 112 is provided in FIG. 7A while the driving transistor 104, the EL element 105 and the capacitor 107 are provided in FIG. 7B. The switching transistor 112 is preferably a multi-gate transistor in order to reduce the off current. Various semiconductors may be applied to the semiconductor for forming a channel portion of each of the switching transistor 112 and the driving transistor 104. For example, an amorphous semiconductor containing silicon as a main component, a semi-amorphous semiconductor (also referred to as a micro-crystalline semiconductor) or a polycrystalline semiconductor may be used. Alternatively, an organic semiconductor may be used. The semi-amorphous semiconductor is formed using a silane gas ($SiH_4$) and a fluorine gas ($F_2$) or using a silane gas and a hydrogen gas. In addition, a polycrystalline semiconductor may be used which is obtained by crystallizing an amorphous semiconductor formed by a physical vapor deposition method such as sputtering or a chemical vapor deposition method such as vapor phase growth, by irradiation with electromagnetic energy such as a laser beam. Each gate of the switching transistor 112 and the driving transistor 104 preferably has a stacked-layer structure of tungsten (W) and tungsten nitride (WN), a stacked-layer structure of molybdenum (Mo), aluminum (Al) and Mo or a stacked-layer structure of Mo and molybdenum nitride (MoN).

Wirings 204, 205, 206 and 207 connected to sources or drains of the switching transistor 112 and the driving transistor 104 are each formed to have a single-layer structure or a stacked-layer structure using a conductive material. For example, a stacked-layer structure of titanium (Ti) and silicon aluminum (Al—Si), a stacked-layer structure of Mo and Al—Si, or a stacked-layer structure of MoN and Al—Si may be employed. Note that such wirings 204, 205, 206 and 207 are formed over a first insulating layer 203.

The EL element 105 has a stacked-layer structure of the first electrode 211 corresponding to the pixel electrode, a light-emitting layer 212 and a second electrode 213 corresponding to a counter electrode. Ends of the first electrode 211 are covered with a partition layer 210. The light-emitting layer 212 and the second electrode 213 are stacked so as to overlap the first electrode 211 in an opening of the partition layer 210. The overlapped portion corresponds to the EL element 105. In the case where both the first electrode 211 and the second electrode 213 transmit light, the EL element 105 emits light in the direction of the first electrode 211 and the direction of the second electrode 213. That is, the EL element 105 emits light to both the top and bottom sides. Alternatively, in the case where one of the first electrode 211 and the second electrode 213 transmits light while the other blocks light, the EL element 105 emits light in the direction of the first electrode 211 or the direction of the second electrode 213. That is, the EL element 105 emits light to the top side or the bottom side.

FIG. 7B shows an example of a cross-sectional structure in the case where the EL element 105 emits light to the bottom side. The capacitor 107 is disposed between the gate and source of the driving transistor 104, and holds the gate-source voltage. The capacitor 107 is formed by a semiconductor layer 201 provided in the same layer as semiconductor layers for forming the switching transistor 112 and the driving transistor 104, conductive layers 202*a* and 202*b* (hereinafter collectively referred to as a conductive layer 202) provided in the same layer as the gates of the switching transistor 112 and the driving transistor 104, and an insulating layer interposed therebetween.

The capacitor 107 is also formed by the conductive layer 202 provided in the same layer as the gates of the switching transistor 112 and the driving transistor 104, a wiring 208 provided in the same layer as the wirings 204, 205, 206 and 207 connected to the sources or drains of the switching transistor 112 and the driving transistor 104, and an insulating layer interposed therebetween. Accordingly, the capacitor 107 can have capacity high enough to hold the gate-source voltage of the driving transistor 104. In addition, by forming the capacitor 107 to overlap a conductive layer for forming the power source line Vx, decrease in the aperture ratio due to the provision of the capacitor 107 is suppressed.

Each thickness of the wirings 204, 205, 206 and 207 connected to the sources or drains of the switching transistor 112 and the driving transistor 104, and the wiring 208 is 500 to 2000 nm, or preferably 500 to 1300 nm. The wirings 204, 205, 206, 207 and 208 constitute the data line Dx or the power source line Vx; therefore, by forming the wirings 204, 205, 206, 207 and 208 to be thick, an effect of a voltage drop can be suppressed.

The first insulating layer 203 and a second insulating layer 209 are formed using inorganic materials such as silicon oxide or silicon nitride, organic materials such as polyimide or acrylic, and the like. The first insulating layer 203 and the second insulating layer 209 may be formed using the same material or different materials. As the organic material, a siloxane-based material may be used. The siloxane is composed of a skeleton formed by the bond of silicon (Si) and oxygen (O). As a substituent, an organic group containing at least hydrogen (e.g., an alkyl group or aromatic hydrocarbon) is used. Alternatively, a fluoro group may be used as the substituent. Further alternatively, both the fluoro group and the organic group containing at least hydrogen may be used as the substituent.

In addition to the aforementioned structure of the pixel portion of this display device, an external correction circuit and a panel are provided, and the external correction circuit and the panel are connected to each other through an FPC connecting portion. The panel includes a signal line driver circuit, a scan line driver circuit, a pixel portion, a monitoring element portion, a D/A converter and a constant current source. When mounting the D/A converter on a substrate in this display device, the number of the external circuit components can be reduced without increasing FPC terminals by supplying a digital signal inputted to the D/A converter from a video signal line, and controlling the sampling timing of the digital signal with a signal used in the panel, similarly to Embodiment Modes 1 and 2.

EMBODIMENT MODE 5

Description is made on a panel corresponding to one mode of a display device of the invention, on which a pixel portion 111, a scan line driver circuit 108 and a data line driver circuit 109 are mounted. Over the substrate 200, the pixel portion 111 having a plurality of pixels each including the EL element 105, the scan line driver circuit 108, the data line driver circuit 109 and a connection film 217 are provided (see FIG. 8A). The connection film 217 is connected to an external circuit.

Figure 8A:
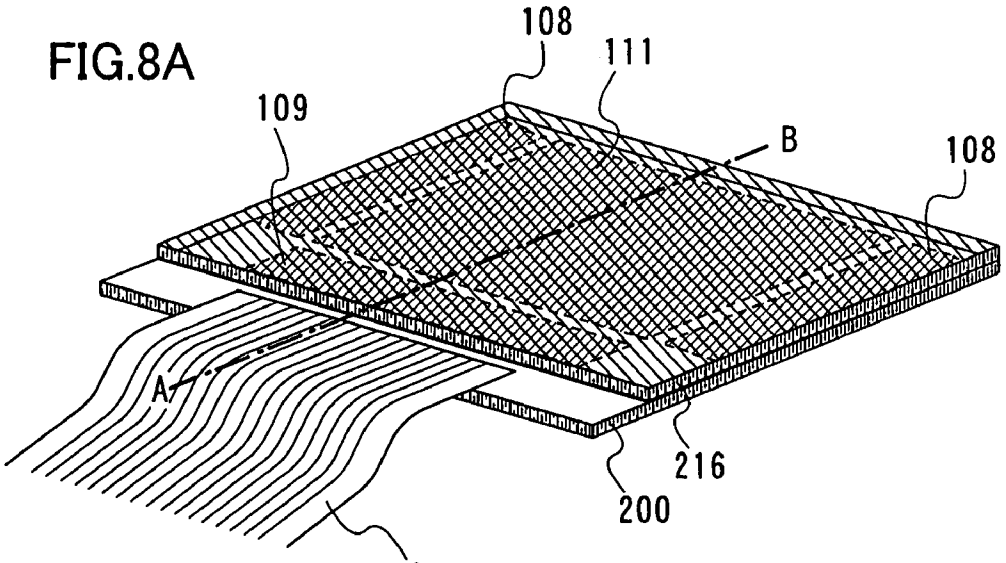
FIGS. 8A and 8B illustrate a configuration example of a display portion, a scan line driver circuit, and a data line driver circuit in the display device of the invention.
Figure 8B:
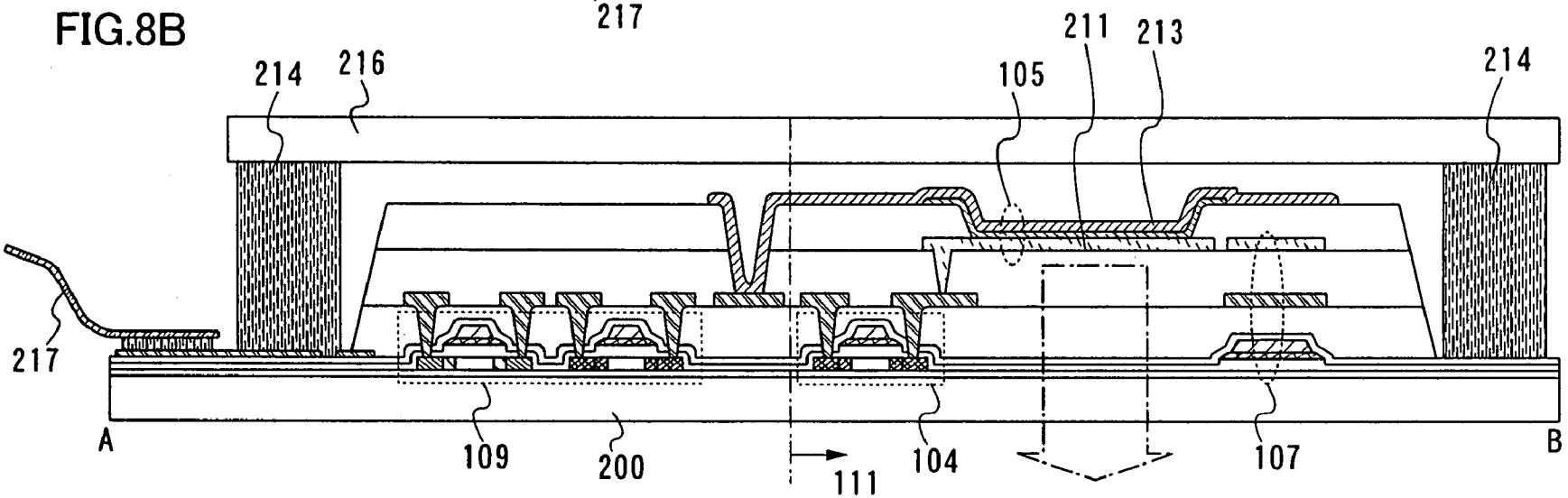

FIG. 8B is a cross-sectional view along a line A-B of the panel in FIG. 8A which shows the driving transistor 104, the EL element 105 and the capacitor 107 provided in the pixel portion 111 and transistors provided in the data line driver circuit 109. A sealant 214 is provided around the pixel portion 111, the scan line driver circuit 108 and the data line driver circuit 109, and the EL element 105 is sealed with the sealant 214 and a counter substrate 216. This sealing process is performed to protect the EL element 105 from moisture, and here, a covering material (e.g., glass, ceramics, plastics or metals) is used for sealing; however, alternatively, a method for sealing with a heat curable resin or an ultraviolet curable resin or a method for sealing with a thin film having a high barrier property such as a metal oxide or a metal nitride may be used. Elements formed over the substrate 200 are preferably formed using crystalline semiconductors (polysilicon) having excellent properties such as mobility as compared to an amorphous semiconductor, thereby monolithic integration over the same substrate can be realized. The panel having such a structure has a smaller number of external ICs to be connected; therefore, downsizing, weight saving and thin shape can be realized.

Figure 9A:
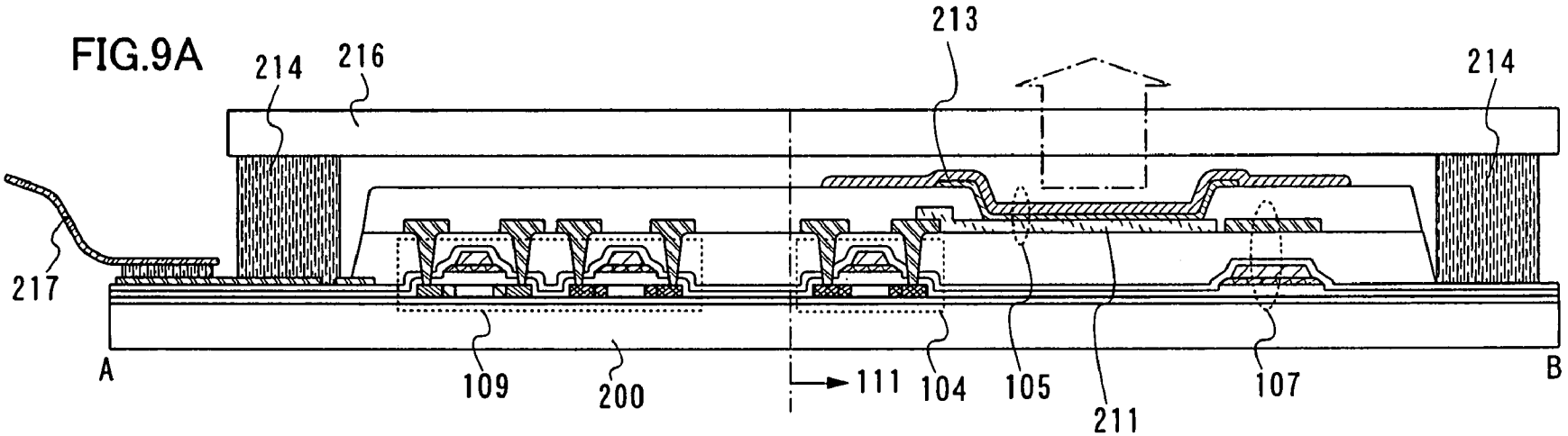
FIGS. 9A and 9B illustrate a configuration example of a display portion, a scan line driver circuit and a data line driver circuit in the display device of the invention.
Figure 9B:
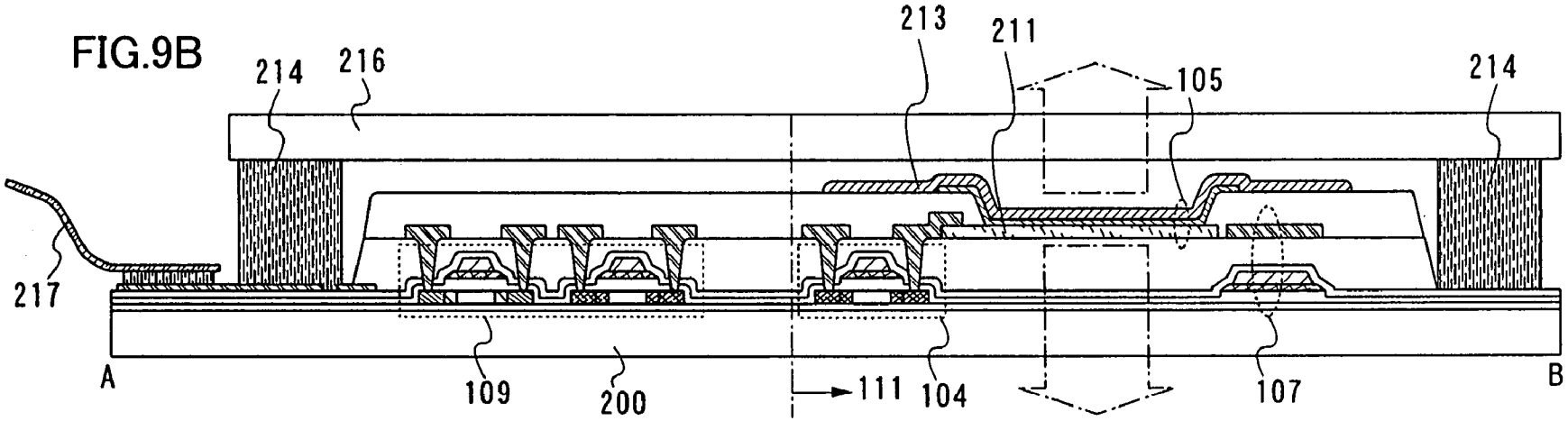

Note that in the aforementioned structure shown in FIGS. 8A and 8B, the first electrode 211 of the EL element 105 transmits light while the second electrode 213 thereof blocks light. Accordingly, the EL element 105 emits light to the substrate 200 side. Alternatively, as shown in FIG. 9A, a different structure may be employed such that the first electrode 211 of the EL element 105 blocks light while the second electrode 213 thereof transmits light. In this case, the EL element 105 emits light to the top side. Further alternatively, as shown in FIG. 9B, still a different structure may be employed such that both the first electrode 211 and the second electrode 213 of the EL element 105 transmit light so that light is emitted to both sides. In such modes, a monitoring element may be provided to have the same structure as the EL element.

Note that the pixel portion 111 may be constructed by using transistors of which channel portions are formed using amorphous semiconductors (amorphous silicon) formed over an insulating surface, and the scan line driver circuit 108 and the data line driver circuit 109 may be constructed by using driver ICs. The driver ICs may be mounted on the substrate 200 by COG bonding or mounted on the connection film 217 connected to the substrate 200. The amorphous semiconductor can easily be formed over a large-area substrate by using a CVD method without requiring a crystallization step; therefore, an inexpensive panel can be provided. At this time, by forming a conductive layer by a droplet discharge method typified by an inkjet deposition method, a more inexpensive panel can be provided.

In addition to the aforementioned structure of the pixel portion of this display device, an external correction circuit and a panel are provided, and the external correction circuit and the panel are connected to each other through an FPC connecting portion. The panel includes a signal line driver circuit, a scan line driver circuit, a pixel portion, a monitoring element portion, a D/A converter and a constant current source. When mounting the D/A converter on a substrate in this display device, the number of the external circuit components can be reduced without increasing FPC terminals by supplying a digital signal inputted to the D/A converter from a video signal line, and controlling the sampling timing of the digital signal with a signal used in the panel, similarly to Embodiment Modes 1 and 2.

EMBODIMENT MODE 6

In this embodiment mode, description is made with reference to FIGS. 10A to 10D on electronic appliances which are completed in accordance with the invention.

As examples of an electronic appliance manufactured by using the display device shown in Embodiment Modes 1 to 4, there are a television set, a video camera, a digital camera, a goggle display (head mounted display), a navigation system, an audio reproducing apparatus (e.g., a car audio set or an audio component stereo), a personal computer, a game machine, a portable information terminal (e.g., a mobile computer, a portable phone, a portable game machine or an electronic book), an image reproducing apparatus provided with a recording medium (specifically, a device for reproducing a recording medium such as a digital versatile disk (DVD) and having a display device for displaying the reproduced image), a lighting apparatus and the like. FIGS. 10A to 10D show specific examples of the electronic appliance.

Figure 10A:
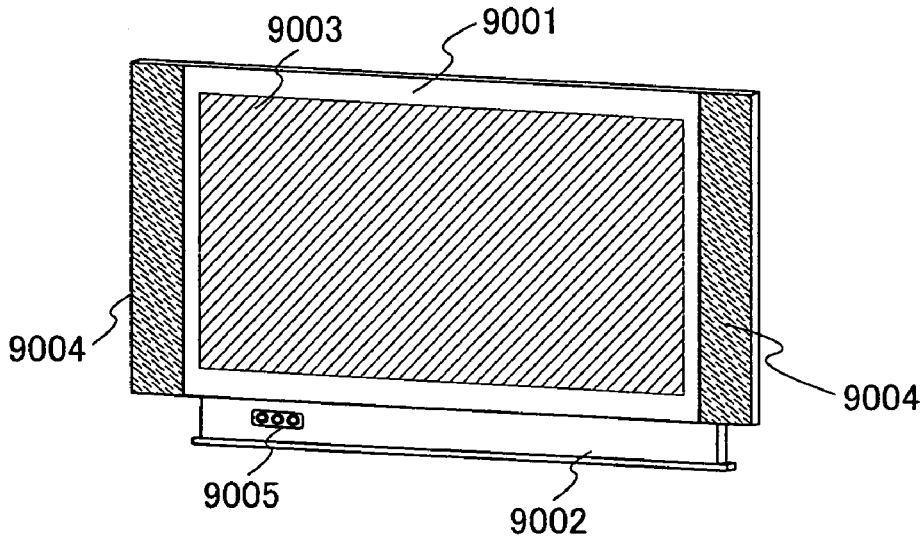
FIGS. 10A to 10D are electronic appliances to which the light-emitting device of the invention is applied.

FIG. 10A is a television set which includes a housing 9001, a supporting base 9002, a display portion 9003, a speaker portion 9004, a video input terminal 9005 and the like. By applying the display device formed in accordance with the invention to the display portion 9003, the television set can be manufactured. The display device in accordance with the invention is provided with a function to control a current value of a constant current source for driving a monitoring element by using a signal sampled from a video signal. Accordingly, luminance of the display portion 9003 can be maintained at constant without increasing the components or input terminals.

Figure 10B:
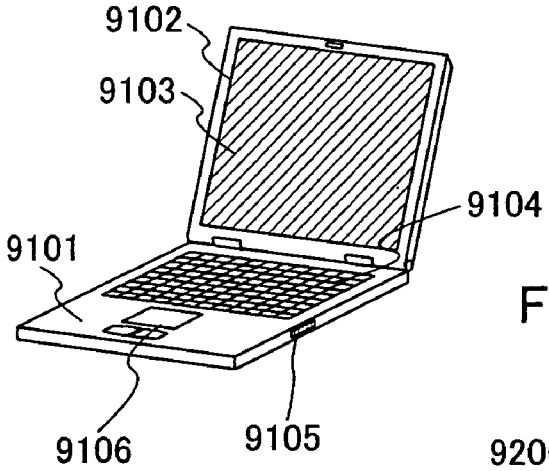

FIG. 10B is a personal computer which includes a main body 9101, a housing 9102, a display portion 9103, a keyboard 9104, an external connection port 9105, a pointing mouse 9106 and the like. By applying the display device having light-emitting elements of the invention to the display portion 9103, the personal computer can be manufactured. The display device in accordance with the invention is provided with a function to control a current value of a constant current source for driving a monitoring element by using a signal sampled from a video signal. Accordingly, luminance of the display portion 9103 can be maintained at constant without increasing the components or input terminals.

Figure 10C:
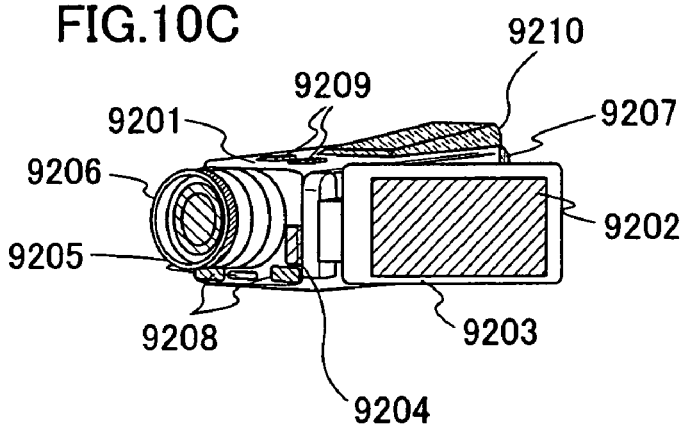

FIG. 10C is a video camera which includes a main body 9201, a display portion 9202, a housing 9203, an external connection port 9204, a remote controller receiving portion 9205, an image receiving portion 9206, a battery 9207, an audio input portion 9208, operating keys 9209, an eyepiece portion 9210 and the like. By applying the display device having light-emitting elements of the invention to the display portion 9202, the video camera can be manufactured. The display device in accordance with the invention is provided with a function to control a current value of a constant current source for driving a monitoring element by using a signal sampled from a video signal. Accordingly, luminance of the display portion 9202 can be maintained at constant without increasing the components or input terminals.

Figure 10D:
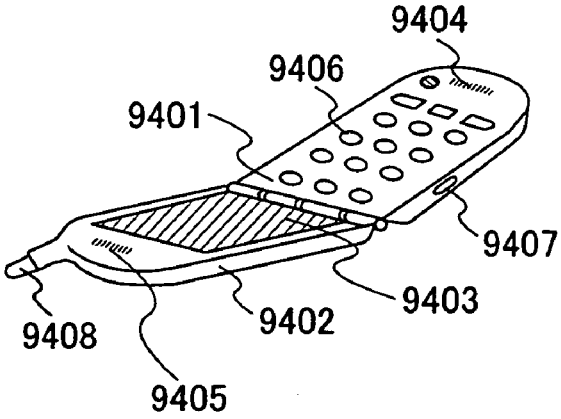

FIG. 10D is a portable phone which includes a main body 9401, a housing 9402, a display portion 9403, an audio input portion 9404, an audio output portion 9405, an operating key 9406, an external connection port 9407, an antenna 9408 and the like. By applying the display device having light-emitting elements of the invention to the display portion 9403, the portable phone can be manufactured. The display device in accordance with the invention is provided with a function to control a current value of a constant current source for driving a monitoring element by using a signal sampled from a video signal. Accordingly, luminance of the display portion 9403 can be maintained at constant without increasing the components or input terminals.

As set forth above, electronic appliances and lighting apparatuses using the display device of the invention can be provided. The applicable range of the display device having light-emitting elements of the invention is so wide that the invention can be applied to electronic appliances in various fields.

The present application is based on Japanese Priority application No. 2004-339671 filed on Nov. 24, 2004 with the Japanese Patent Office, the entire contents of which are hereby incorporated by reference.

What is claimed is:

1. A display device comprising:

an external correction circuit including a power source and a signal generator; and a panel being connected to the external correction circuit through a flexible printed wiring, the panel including:

a signal line driver circuit, a scan line driver circuit, a pixel portion including a first thin film transistor, a second thin film transistor and a light-emitting element, a monitoring element portion including a monitoring element and a monitoring line, a D/A converter, and a constant current source circuit, which are formed over a substrate, wherein the signal generator is configured to send a video signal to the signal line driver circuit and the D/A converter through a video signal line, wherein the D/A converter is configured to convert the video signal into an analog signal and to send the analog signal to the constant current source circuit, wherein the constant current source circuit is configured to supply a constant current to the monitoring element through the monitoring line, and a current value of the constant current is controlled based on a potential of the analog signal, wherein a potential of the monitoring line, which corresponds to a potential difference of the monitoring element, is inputted into the external correction circuit, wherein the signal line driver circuit is configured to send the video signal to one of a source and a drain of the first thin film transistor, wherein the other of the source and the drain of the first thin film transistor is electrically connected to a gate of the second thin film transistor, and a gate of the first thin film transistor is electrically connected to the scan line driver circuit, wherein one of a source and a drain of the second thin film transistor is electrically connected to the light-emitting element, and wherein the external correction circuit is configured to send the potential of the monitoring line to the other of the source and the drain of the second thin film transistor.

2. The display device according to claim 1, wherein the potential of the monitoring line is inputted to the light-emitting element through the second thin film transistor.

3. The display device according to claim 1, wherein the video signal is sampled by the D/A converter during a flyback period.

4. The display device according to claim 1, wherein a timing for sampling the video signal by the D/A converter is controlled with a signal used in the panel.

* * * * *

UNITED STATES PATENT AND TRADEMARK OFFICE

CERTIFICATE OF CORRECTION

PATENT NO. : 7,570,233 B2
APPLICATION NO. : 11/281860
DATED : August 4, 2009
INVENTOR(S) : Iwabuchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this

Fourteenth Day of December, 2010

David J. Kappos

David J. Kappos
*Director of the United States Patent and Trademark Office*